United States Patent [19]

Daugherty

[11] 4,409,757

[45] Oct. 18, 1983

[54] SECURITY LATCH ASSEMBLY

[76] Inventor: John Daugherty, 3611 Bangor St., S.E., Washington, D.C. 20020

[21] Appl. No.: 288,262

[22] Filed: Jul. 29, 1981

[51] Int. Cl.[3] ..... E05D 13/04

[52] U.S. Cl. ..... 49/449; 49/56; 49/63; 292/DIG. 46; 292/207

[58] Field of Search ..... 49/449, 63, 425, 56; 292/DIG. 46, 262, 207, 208, 238, DIG. 47

[56] References Cited

U.S. PATENT DOCUMENTS

| | | | |
|---|---|---|---|
| 739,430 | 9/1903 | Lunken | 49/56 |
| 1,634,842 | 7/1927 | McWane | 49/56 X |
| 1,855,865 | 4/1932 | McWane | 49/449 X |
| 2,702,595 | 2/1955 | Rumbaugh et al. | 49/63 X |
| 3,112,635 | 12/1963 | VanHarn et al. | 292/214 X |
| 3,471,189 | 10/1969 | Ness | 292/266 |
| 3,486,781 | 12/1969 | Crum | 292/262 |
| 3,608,940 | 9/1971 | Mueller | 292/262 |
| 3,615,114 | 10/1971 | Harris | 292/262 |
| 3,637,247 | 1/1972 | Manion | 292/262 |
| 3,693,293 | 6/1972 | Egan, Jr. et al. | 49/56 |
| 3,698,754 | 10/1972 | Means | 292/262 |
| 3,698,883 | 10/1972 | Fazio | 49/449 |
| 3,754,783 | 8/1973 | Childers | 292/263 |
| 3,816,967 | 6/1974 | Littrell | 49/449 |
| 3,832,805 | 9/1974 | Stevens | 49/56 X |
| 3,927,906 | 12/1975 | Mieras | 292/262 |

*Primary Examiner*—Philip C. Kannan

*Attorney, Agent, or Firm*—Darle M. Short

[57] ABSTRACT

The assembly is for use with closures located in top and bottom tracks, wherein at least one of the closures is slidable in the tracks between an open and a closed position. The assembly includes an elongated rod member which is swingably attached to the top track and has up and down positions. The assembly is designed such that when the rod member is in the down position, it extends between the edge of the slidable closure and the side of the opening in which the closures are located. This prevents the slidable closure from being moved from the closed to the open position. The security latch assembly also includes a latching assembly which is attached to a wall adjacent to the closures. There is an extension member which is attached to the rod member and extends beyond the closures to the latching assembly. The extension member engages the latching assembly and holds the rod member in either the up or down position. In certain embodiments, if the invention is employed with two slidable closures, the rod member has an end member attached thereto which interfaces with the second slidable closure when the rod member is in the down position and prevents the second closure from being slid within the tracks. In yet other embodiments, the assembly is employed with a pair of security doors which can be placed adjacent and parallel to a pair of sliding glass doors.

34 Claims, 18 Drawing Figures

FIG. 4.
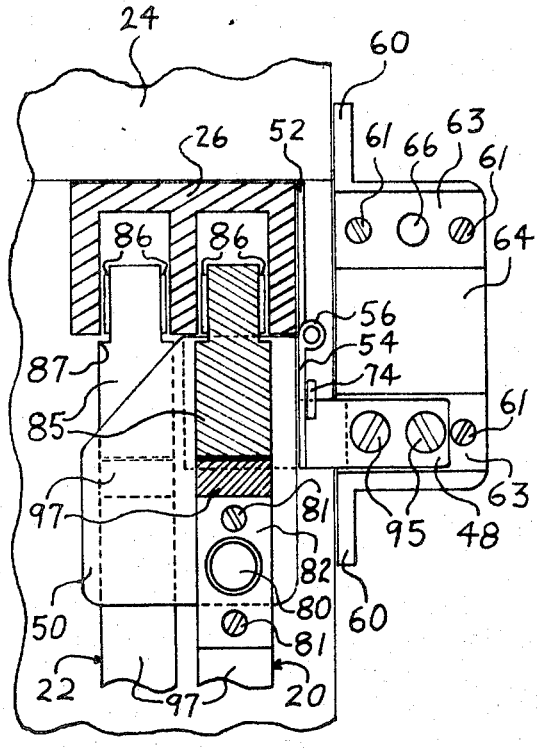
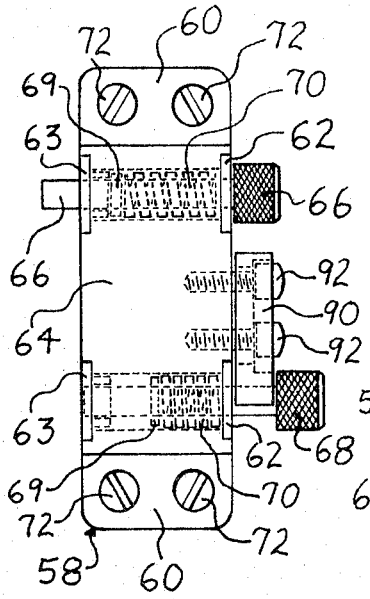
FIG. 8.
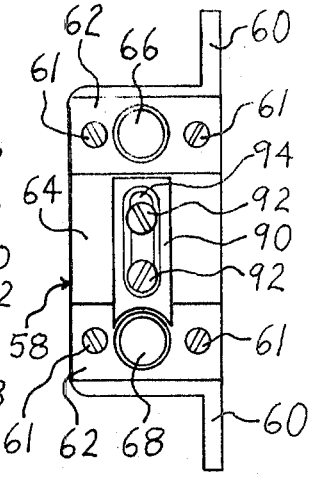
FIG. 7.
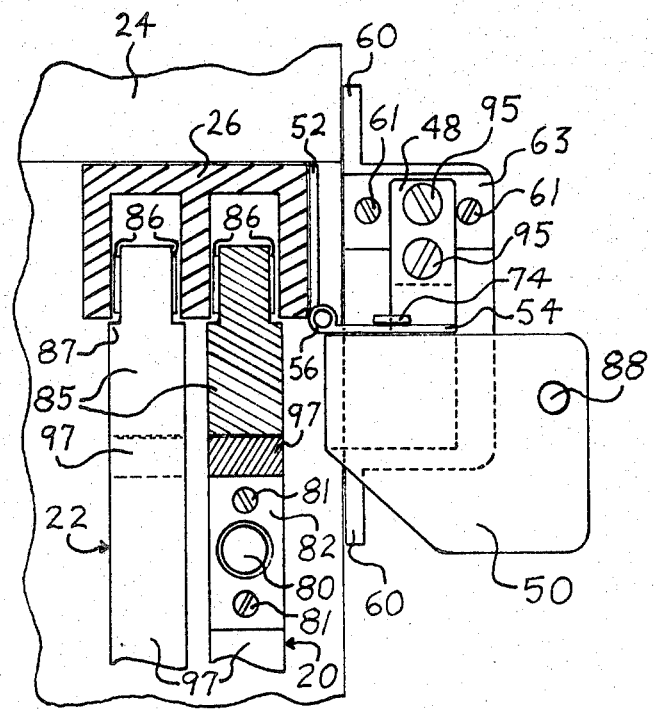
FIG. 6.
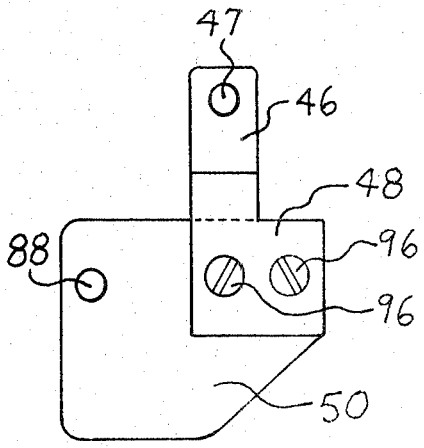
FIG. 9.

85
86
87
89
93
97
98
100
102
103
104
20
31
12

SECURITY LATCH ASSEMBLY

This invention relates to devices for preventing unauthorized entries into a house or other building. More particularly, this invention relates to protective devices to be used in conjunction with sliding glass doors to prevent unauthorized entries therethrough.

BACKGROUND OF THE INVENTION

Sliding glass doors have been used for many years as closures in houses, offices, stores and other structures in lieu of swinging doors. Sliding glass doors have the advantage of being completely transparent so that outside scenery can be enjoyed whether or not the doors are open or, if between two interior rooms, so that one can see the activity in the adjacent room at all times. These doors also have the advantage that they do not interfere with the areas adjacent the doors when opened, unlike swinging doors. For these and other reasons, sliding glass doors are very popular in modern homes and offices.

Sliding glass doors have also been popular with burglars and other intruders. The latches for these doors are often the weakest link in the protective systems of houses or other structures, and thus burglars and other intruders frequently gain unauthorized entry through these sliding glass doors. Most latches that the sliding glass doors are equipped with when sold in retail stores can be easily opened from the outside by a burglar, indeed, some of these latches are so easily opened from the outside that they can be unlocked using a credit card or other similar item by sliding the credit card up in the gap between the door and the door frame.

In view of the above, many supplemental protective devices have been constructed to be used in conjunction with a sliding glass door which block the path of the sliding door and thus deter unauthorized entries. These devices employ rods that are placed between the edge of one sliding door and the side of the door frame across the width of the second glass door, within the plane of the door, to prevent the door from being slid open.

Such devices do add a measure of protection against break-ins. However, a determined burglar can usually still find a way to illegally enter a room even when these devices are employed. This entry can be gained by breaking or drilling a small hole in the glass and unlatching the rod-like device.

From the above, it is obvious that there is a need in the art for a security latch assembly, that can be employed with sliding glass doors, that has a higher ability to prevent unauthorized entries through the same than devices currently employed.

This invention fulfills this need, along with many other needs apparent to those skilled in the art once given the following disclosure:

SUMMARY OF THE INVENTION

Generally speaking, this invention provides a security rod assembly for use with a pair of closures located in top and bottom tracks, at least a first and second of said closures being slidable between an open and a closed position in said tracks, said security rod assembly comprising an elongated rod member swingably attached to the top track such that it has an up position and a down position, wherein when said rod member is in the down position said rod member extends between the edge of said first closure and the edge of the opening preventing said first closure from being slid from the closed position to the open position and when said rod member is in the up position it does not interfere with the sliding of said first closure, and an end member attached to said rod member such that when said rod member is in the down position said end member engages said second door in a manner such that said second closure can not be slid.

In certain embodiments of this invention, the invention includes a latching assembly which is attached to the wall adjacent the closures a short distance from the closest edge of the closures. These embodiments also include an extension member which is attached to the rod member, extends from the rod member to the latching assembly and is compatible with the latching assembly. The extension member and the latching assembly are designed such that the extension member and thus the rod member can be held in its two positions by the latching assembly.

In other embodiments of this invention, the rod member is a rectangular metal rod that has a length slightly less than the width of one of the closures. The rod is oriented parallel to the top track and top edges of the closures at all times.

In some embodiments, the latching assembly includes a first and a second locking pin that alternatively engage a hole in the end of the extension member to hold the extension member, and thus the rod member, in the up and down positions.

In further embodiments, the rod assembly is designed to be employed with a pair of metal grillwork doors located in tracks adjacent and parallel to a pair of sliding glass doors. The rod member in these embodiments is swingably attached to the tracks of the metal doors and prevents the movement of these doors when the rod member is in the down position. The use of these metal doors makes it increasingly difficult for any intruder to enter thru these doors if they are latched since even if the intruder breaks or opens the outer glass doors, he is then confronted with the pair of metal doors. Since the latching mechanism on the metal doors can be located very high and is offset along the wall, it is very difficult for burglars to manipulate these doors and gain unauthorized entry through the doors. The metal doors can be of an ornamental grillwork such that they do not distract from the aesthetics of the doors, so that the outside scenery can still be viewed through the doors and so that a minimal amount of sunlight is blocked by the doors. Furthermore, the metal doors can be mounted on rollers such that they are easily slid within their tracks. Moreover, for added security, a locking assembly can be provided which attaches the end member to one of the doors when the rod member is in the down position.

In addition to the advantages set forth above, security latch assemblies according to this invention have the following advantages.

One advantage of this invention is that it provides a security latch which is very difficult to unlatch from the outside.

Another advantage of this invention is that it is compatible with a pair of metal doors which can be employed in conjunction with sliding glass doors without destroying the aesthetic advantages of the sliding glass doors as noted above. This combination acts as a double deterrent against unauthorized entries. The metal doors can provide security even if the glass doors are opened for ventilation.

A further advantage of this invention when employed with a pair of metal doors is that the arrangement is ornamental and attractive.

Yet another advantage of this invention is that it is of a simple, yet strong construction, and is easy to operate.

It is also an advantage of this invention that the invention can be employed with conventional sliding closures and does not interfere with the existing wall and frame structure, even if the embodiments including sliding metal doors are employed.

This invention also has the advantage of providing a deterrent effect on potential burglars who may not attempt entry upon confronting the embodiments of this invention employing the metal doors.

This invention has the advantage that the security rod can be latched out of the way when desired such that it does not interfere with the movement of the doors.

Another advantage of this invention is that it secures two slidable doors, not just one door as does the prior art, in a closed position.

This invention will now be described with respect to the drawings, wherein:

IN THE FIGURES

FIG. 4 is a cross sectional view taken along line 4—4 of FIG. 3.

FIG. 6 is a cross sectional view taken along line 6—6 of FIG. 5.

FIG. 7 is a side view of the embodiment of the latching assembly shown in FIGS. 3-6.

FIG. 8 is a front view of the latching assembly illustrated in FIG. 7 showing the pin head support in the down position, holding the bottom locking pin open.

FIG. 9 is an end view of one embodiment of the security rod member, extension member, connecting plate and end plate that can be employed in the practice of this invention.

DETAILED DESCRIPTION OF THE DRAWINGS

Figure 2:
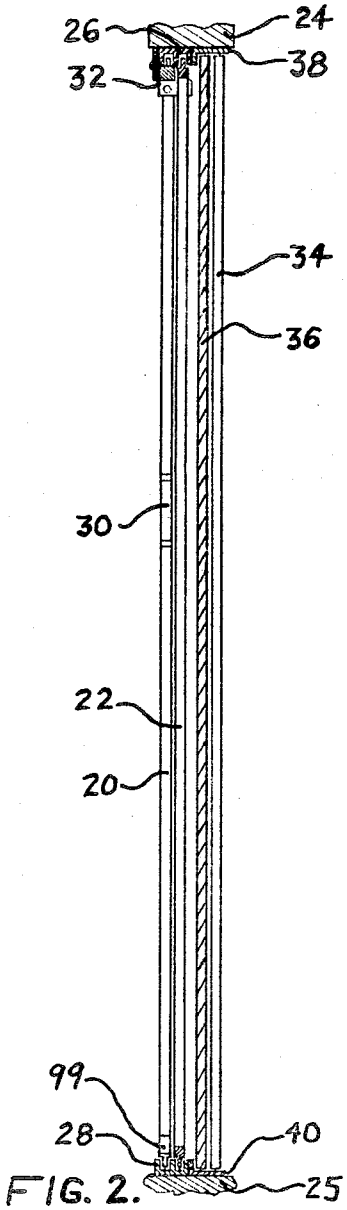
FIG. 2 is a cross sectional view taken along line 2—2 of FIG. 1.
Figure 1:
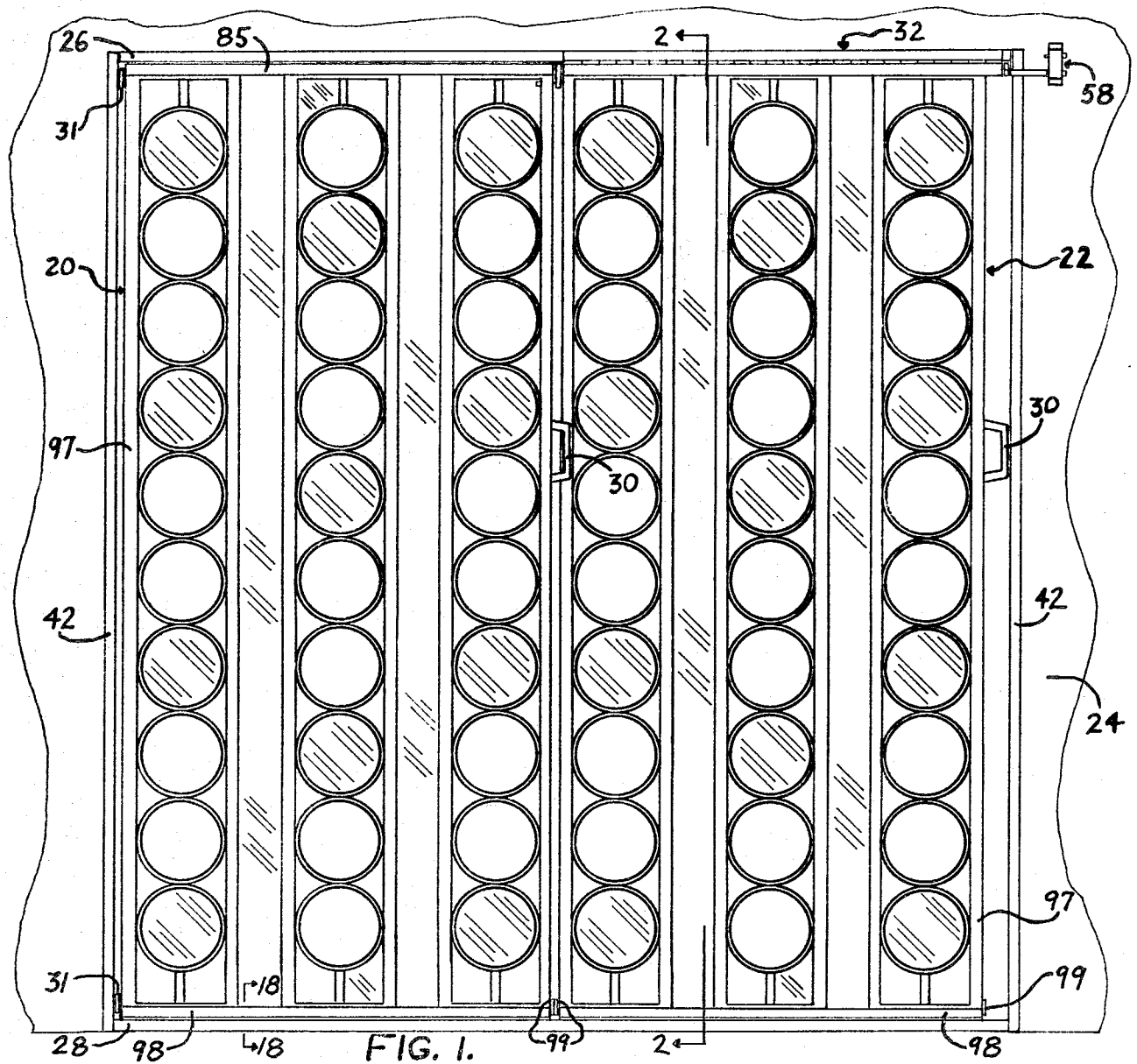
FIG. 1 is a front view (looking from the inside of a room outward) of one embodiment of this invention installed within a closure of a room.

Referring to the Figures, in particular FIGS. 1 and 2, one embodiment of this invention is illustrated in one environment in which it can be utilized. This environment is a typical sliding glass door arrangement as found in many homes and offices between a room in the house (or office) and a deck, patio, adjacent office, hallway, etc., consisting essentially of sliding glass doors 34 and 36 located in upper track 38 and lower track 40. Upper track 38 and lower track 40 are attached to wall 24 and floor 25 by conventional building methods. Sliding glass doors 34 and 36 are the closures of an opening in wall 24. The side edges of the opening are bordered by corner moulding 42.

Figure 16:
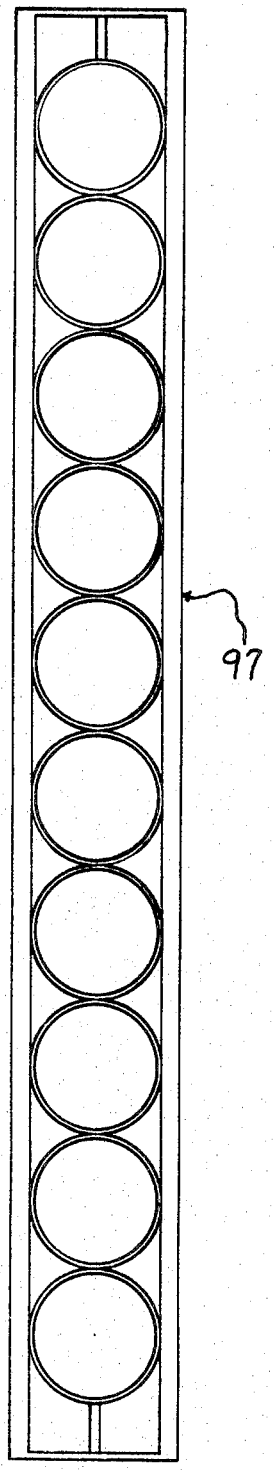
FIG. 16 is a front view of one embodiment of the protective panels which comprise the doors of the embodiment of this invention illustrated in FIG. 1.
Figure 17:
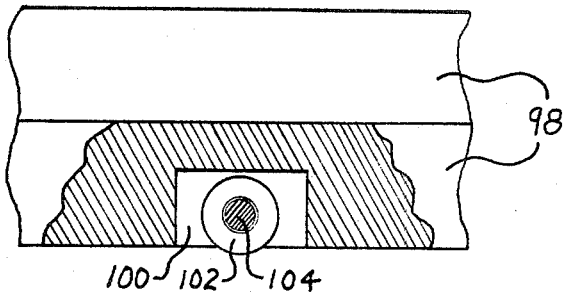
FIG. 17 is a side view, partially sectionalized for clarity, of a roller assembly (along with a portion of a bottom guide) which can be employed in the practice of this invention.

To incorporate the embodiment of this invention shown in the Figures into this environment, upper track 26 and lower track 28 are attached to wall 24 and floor 25 adjacent to the inside of tracks 38 and 40 (see FIG. 2). Metal doors 20 and 22 are then inserted into tracks 26 and 28. Doors 20 and 22 are comprised of bottom guides 98, top guides 85 and a plurality of protective panels 97. In this embodiment, protective panels 97 are panels of metal grillwork and are attached to guides 85 and 98 by flat head screws 103. Protective panels 97 can be of any shape and size of grillwork, however, the circular design shown in FIGS. 1 and 16 has many advantages. This design has the advantages of being aesthetically pleasing and minimizing the portion of the natural light blocked out by metal doors 20 and 22. It is preferred that both metal doors 20 and 22 slide within tracks 26 and 28 (for cleaning maintenance of the sliding glass windows, etc.), however, it is possible to practice this invention having only one of doors 20 and 22 be slidable in tracks 26 and 28. Doors 20 and 22 have handles 30 attached thereto for opening and closing the doors.

Metal doors 20 and 22 are easily slidable in tracks 26 and 28 but are difficult to remove from tracks 26 and 28 because they are constructed as follows. Bottom guides 98 comprise the bottom edge of doors 20 and 22 as shown in FIGS. 10-12 and 18. Bottom guides 98 are solid pieces of metal with spaced holes 100 in the bottom thereof to receive rollers 102. Rollers 102 extend out the bottom of bottom guides 98 to engage bottom track 28 and are mounted on axles 104. Axles 104 are in turn attached to bottom guides 98. Rollers 102 are ring bearings in the embodiment illustrated in the Figures so that metal doors 20 and 22 can be easily opened. Any other type of roller or sliding means could, of course, be substituted for the ring bearings.

Comprising the top edge of metal doors 20 and 22 are top guides 85 (see FIGS. 4, 6 and 13-15) which are similar to bottom buides 98. Top guides 85 have spaced notches therein to receive rollers 86. Rollers 86 are attached to top guide 85 by roller retaining screws 89 and have a vertical axis of rotation. Rollers 86 have a diameter larger than the width of the top of top guide 85 so that only rollers 86, and not top guide 85, engage top track 26.

Figures 10, 11, 12, 13, 14, 15:
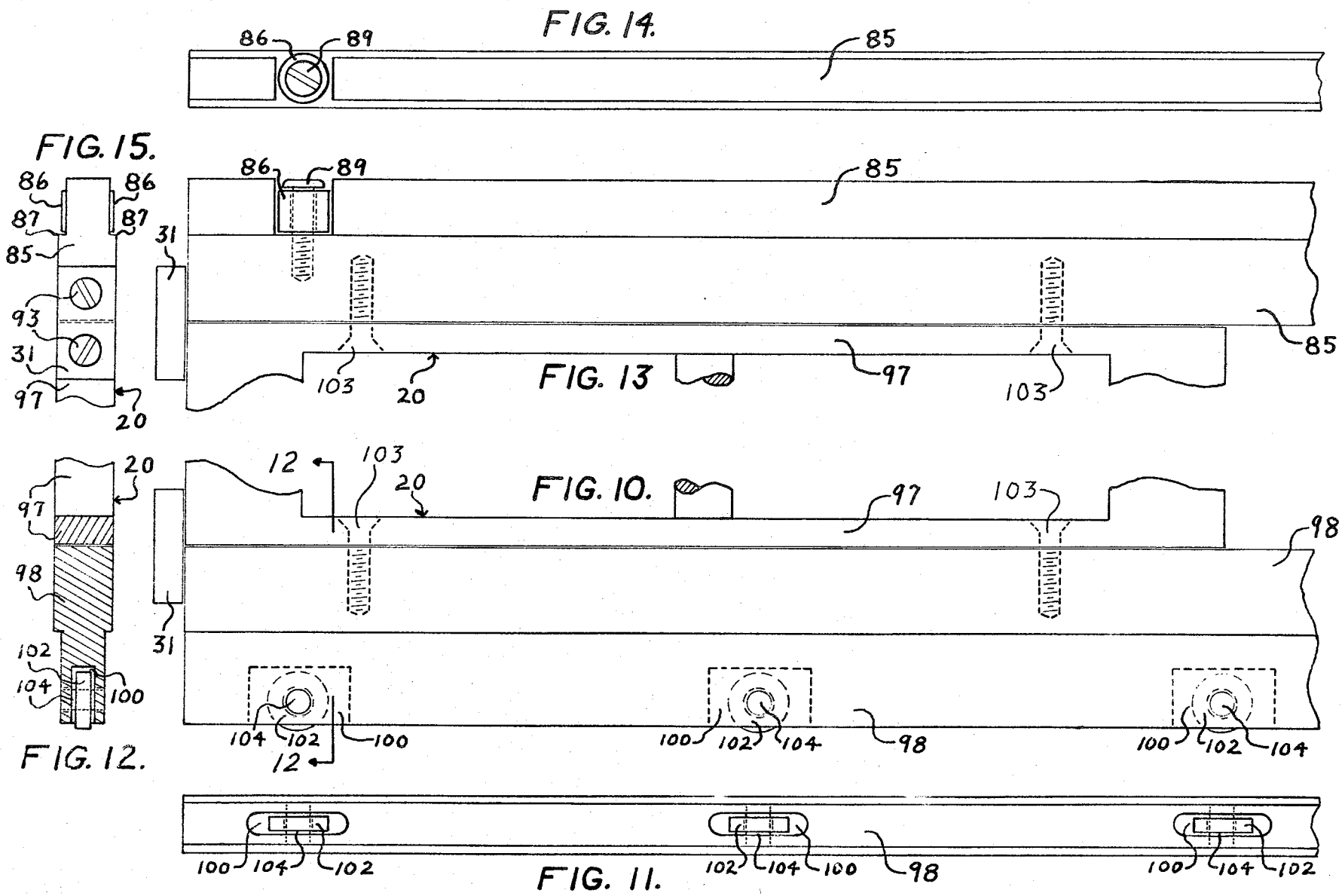
FIG. 10 is a front view of a portion of one embodiment of a bottom guide which can be employed in the practice of this invention.
FIG. 11 is a bottom view of the portion of the bottom guide illustrated in FIG. 10.
FIG. 12 is a cross sectional view taken along line 12—12 of FIG. 10.
FIG. 13 is a front view of a portion of one embodiment of a top guide which can be employed in the practice of this invention.
FIG. 14 is a top view of the portion of the top guide illustrated in FIG. 13.
FIG. 15 is a side view of the top guide illustrated in FIGS. 13 and 14.
Figure 18:
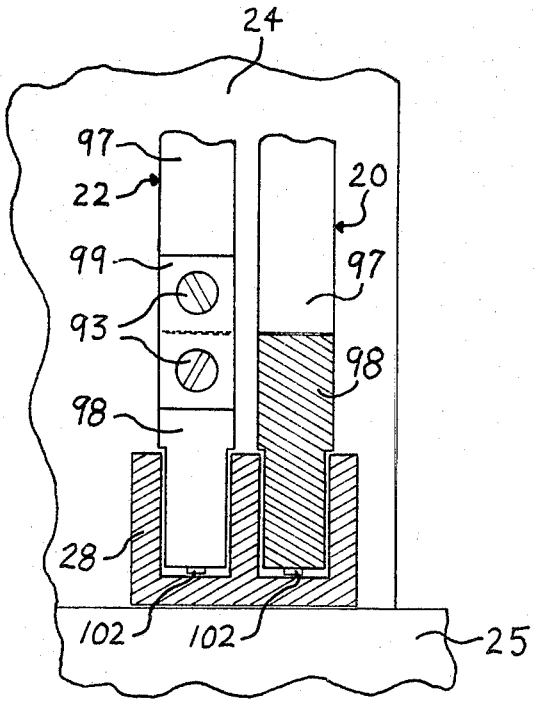
FIG. 18 is a cross sectional view taken along reference line 18—18 of FIG. 1.

Doors 20 and 22 must be placed in tracks 26 and 28 unassembled with either bottom gude 98 or top guide 85 unattached from protective panels 97. After the respective elements have been placed within tracks 26 and 28, the door can be assembled by attaching either bottom guide 98 or top guide 85 to protective panels 97 by screws 103. For additional protection against breakins, guides 85 and 98 could be further attached to the ends of protective panels 97 by binding plates 99 and door stops 31 which can be attached to and overlap the edges of guides 85 and 98 and protective panels 97 as shown in FIGS. 1, 15 and 18. Door stops 31 could be made of a metal or hard rubber and also act as padding between doors 20 and 22 and corner moulding 42. Thus, when binding plates 99 and/or door stops 31 are used and when doors 20 and 22 are closed and latched shut, it is impossible for an intruder to break into the house by removing doors 20 and 22 from their respective tracks. The first deterrent to such an effort would be that if the intruder tried to lift metal doors 20 and 22 from their tracks, shoulders 87 (see FIGS. 4 and 6) of top guide 85 will not fit into top track 26, thus making it impossible to lift doors 20 and 22 out of their tracks. Therefore, the intruder would have to try to disassembly metal doors 20 and 22. This is not possible since some of the door stops 31 and binding plates 99 will be inaccessible to the intruder, even if he breaks the glass doors, since they will be abutting corner moulding 42.

Figure 3:
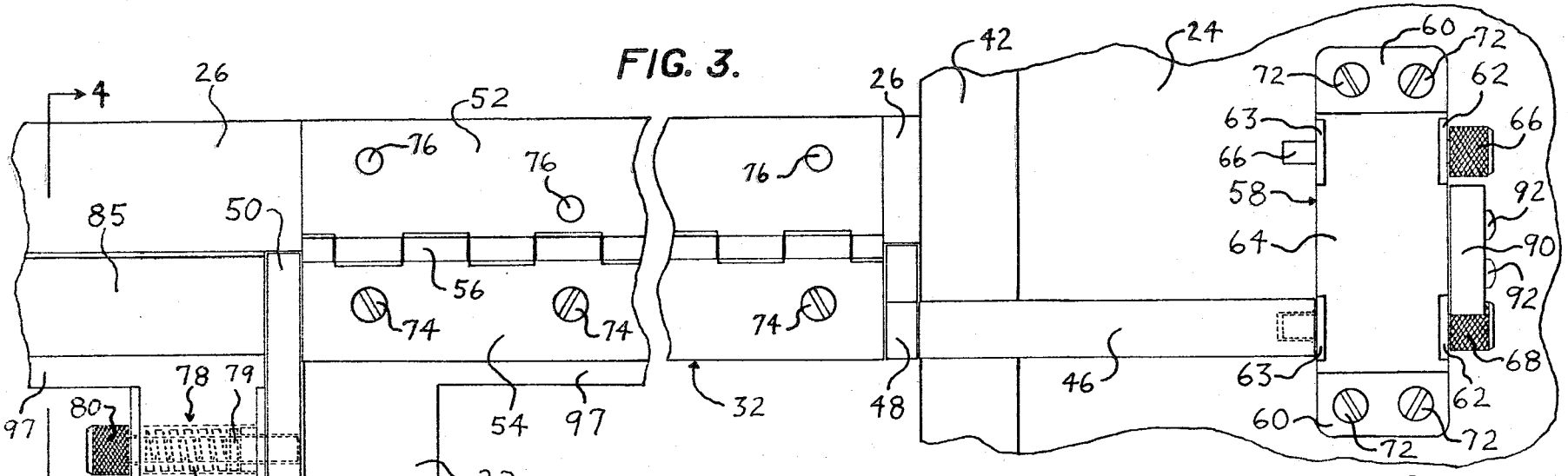
FIG. 3 is a front view of one embodiment of a security rod assembly and latching assembly which can be employed in the practice of this invention, with the security rod member being in the down (or locking) position.
Figure 5:
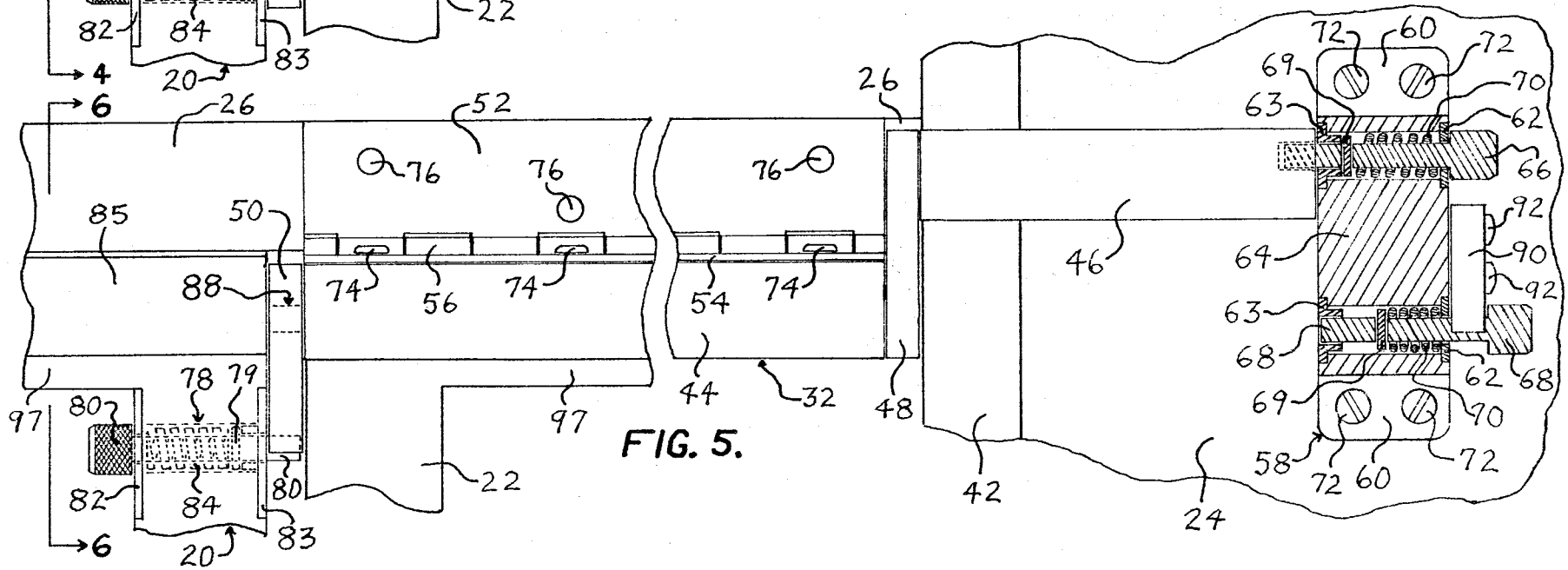
FIG. 5 is a front view of the embodiment of the security rod assembly and latching assembly illustrated in FIG. 3, however, in this Figure the security rod member is in the up (or open) position and the latching assembly (except for the pin head support) is partially sectionalized for clarity.

Included in the embodiment of the invention illustrated in the Figures is security rod assembly 32. Security rod assembly 32 includes piano hinge 56 having top plate 52 and bottom plate 54, security rod 44, extension rod 46, rod connecting plate 48 and end plate 50. Top plate 52 is attached to top track 26 by rivets 76. Security rod 44 is attached to bottom plate 54 by binding head screws 74, enabling security rod 44 to rotate from a down position as shown in FIGS. 3 and 4 to an up position as shown in FIGS. 5 and 6. Connecting plate 48 is attached to the ends of rods 44 and 46, intermediate rods 44 and 46, such that rods 44 and 46 extend out in opposite directions from, and perpendicular to, connecting plate 48 and are offset from each other. Flat head screws 95 are employed to attach connecting plate 48 to one end of extension rod 46 and flat head screws 96 are employed to attach one end of security rod 44 to connecting plate 44. Rods 44 and 46 are offset by connecting plate 48 so that rod 46 extends alongside the wall when rod 44 is in the down position within the plane of the wall.

Extension rod 46 has hole 47 in the end opposite from the end connected to connecting plate 48. Hole 47 engages latching assembly 58 (which is described later in detail) to hold security rod 44 in its up and down positions.

End plate 50 is attached to the end of rod 44 opposite the end connected to connecting plate 48. End plate 50 is of a thickness such that it fits into the gap created between doors 20 and 22 when doors 20 and 22 are completely closed. End plate 50 has hole 88 therethrough that is engaged by locking assembly 78 (described below in more detail) when security rod assembly 32 is in the down position.

Latching assembly 58, in the embodiment of this invention illustrated in the Figures, is comprised essentially of housing 64, top locking pin 66, bottom locking pin 68 and pin head support 90. Latching assembly 58 is attached to the wall 24 adjacent to and inset from the door opening as shown in the Figures. Housing 64 is a solid piece of metal having outer flanges 60, in this embodiment, which are attached by wood screws 72 to wall 24. Holes are drilled through housing 64 to insert locking pins 66 and 68 therein, slots are journaled on the side faces of housing 64 to receive support plates 62 and 63 and holes are drilled in housing 64 to receive fillister head screws 92.

Latching assembly 58 can be assembled as follows. Bolt head support plates 62 and springs 70 are slid on locking pins 66 and 68 and spring-locking pins 69 are inserted through holes in locking pins 66 and 68 to hold springs 70 in place. These assemblies are then inserted in the right end of the appropriate holes in housing 64 and pin head support plates 62 are attached to housing 64 by flat head screws 61. Rod support plates 63 are then placed around the ends of locking pins 66 and 68 on the left side of housing 64 and attached to housing 64 by flat head screws 61. Lastly, pin head support 90 is attached to housing 60 by fillister head screws 92.

Pin head support 90 has slot 94 therein in which screws 92 are located when pin head support 90 is properly attached to housing 64. Pin head support 90 is slidable with respect to screws 92 and slot 94 serves as the guide and limiting means for the movement of pin head support 90.

Attached to the upper right edge of door 20 is locking assembly 78 (see FIGS. 3 and 5). Locking assembly 78 is comprised of the same elements as found in latching assembly 58; locking pin 80, pin head support plate 82, pin support plate 83, spring locking pin 79 and spring 84. These elements are attached to door 20 the same as the similar elements are attached to housing 64.

This invention is employed as follows. The elements of this embodiment of the invention are assembled as discussed above. First tracks 26 and 28 are installed and doors 20 and 22 are assembled within tracks 26 and 28. Next, security rod assembly 32 is attached to track 26 and latch assembly 58 is attached to wall 24. To place security rod assembly 32 in the up position, bottom plate 54 of piano hinge 56 is turned to approximately a 90° angle with top plate 52. Top locking pin 66 is inserted in hole 47 in the end of extension rod 46 as shown in FIG. 5 to hold security rod assembly 32 in the up position. When security rod assembly 32 is in this position, both doors 20 and 22 are free to be slid back and forth within tracks 26 and 28 since, as shown in FIG. 6, when security rod assembly 32 is in the up position security rod 44 and end plate 50 are located outside the planes of doors 20 and 22.

To move the security rod assembly 32 from the up position to the down position (shown in FIGS. 3 and 5), top locking pin 66 is pulled out from hole 47, unlatching extension rod 46. Rods 44 and 46 are then rotated downward until hole 47 in extension rod 46 is in line with bottom locking pin 68. Locking pin 68 is then brought into engagement with hole 47 latching security rod assembly 32 in the down position. When the security rod assembly 32 is in this position rod 44 lies directly in the path of door 20 such that it can not be opened. Also, end plate 50 has been rotated such that it extends between doors 20 and 22 into the path of door 22 so that door 22 can also not be opened. As an additional preventive measure, locking pin 80 on door 20 is brought into engagement with hole 88 in end plate 50.

The first stp in moving security rod assembly 32 back to the up position is to pull bottom locking pin 68 back until the end thereof is free from hole 47 in extension rod 46. Pin head support 90 is then either slid or falls by gravity to the position shown in FIG. 8, between the head of pin 68 and housing 64 bracing bottom locking pin 68 open. Next, locking pin 80 is pulled back so that it disengages hole 88 in end plate 50. Rods 44 and 46 are then swung upwardly around piano hinge 56 until security rod assembly 32 is back to the open position and top pin 66 is engaging hole 47.

Many different embodiments and variations of the invention can, of course, be constructed. Many of the features discussed above are optional in the practice of this invention. For example, it is not necessary to have locking assembly 78 to practice this invention.

Moreover, it is not necessary to have the two additional metal doors in conjunction with the sliding glass doors to practice this invention. The security rod assembly of this invention could be employed with ordinary glass patio doors as long as one of the doors had an indentation therein to receive the end plates. Furthermore, any type of latching means could be employedin lieu of the locking pins.

In addition, for added protection the latching assembly could be connected to an electronic signaling device which would emit a signal whenever the extension rod was unhooked from the latching assembly when the electronic signaling device was on. The electronic signaling device could be a separate unit built just for this purpose or it could be a signaling device already in place in the building.

As can be seen from the above, many other embodiments, improvements and modifications of this invention will become apparent to those skilled in the art once given the above disclosure. These other embodiments, modifications and improvements are considered to be within the scope of this invention as defined by the following claims:

I claim:

1. A security rod assembly for use with closures located in top and bottom tracks, at least a first and second of said closures being slidable between an open and a closed position in said tracks, said security rod assembly comprising:

an elongated rod member swingably attached to the top track such that it has an up position and a down position, wherein when said rod member is in the down position said rod member extends between the edge of said first closure and the edge of the opening preventing said first closure from being slid from the closed position to the open position, and when said rod member is in the up position it does not interface with the sliding of said first closure, an end member attached to said rod member such that when said rod member is in the down position said end member engages said second door in a manner such that said second closure cannot be slid, a latching assembly attached to a wall adjacent to said closures, and, an extension member attached to said rod member and extending beyond said closures to said latching assembly, wherein said extension member engages said latching assembly to hold said rod member in the up and down positions.

2. A security rod assembly according to claim 1 wherein said extension member is an elongated rod which is attached to said rod member by a connecting plate, said rod member and said extension member being parallel when attached to said connecting plate.

3. A security rod assembly according to claim 2 wherein said connecting plate is attached to one of the ends of said rod member and said extension member intermediate of said rod member and said extension member.

4. A security rod assembly according to claim 3 wherein said rod member is parallel to the top track and the top edge of said closures.

5. A security rod assembly according to claim 4 wherein said rod member is attached to said top track by a piano hinge.

6. A security rod assembly according to claim 5 wherein said end member is connected to the end of said rod member opposite the end of said rod member connected to said connecting plate.

7. A security rod assembly according to claim 6 wherein said end member is a plate, said plate being parallel to the side edges of said closures.

8. A security rod assembly according to claim 7 wherein said closures are metal doors located adjacent to and parallel to sliding glass doors and wherein said end member is between and parallel to the side edges of said metal doors when said rod member is in the down position.

9. A security rod assembly according to claim 7 wherein said end plate extends into the plane of the second closure when the rod member is in the down position.

10. A security rod assembly according to claim 1 further comprising a latching member attached to one of said closures that engages said end member when said rod member is in the down position.

11. A security rod assembly according to claim 10 wherein said end member has a hole therein, said latching member including a locking pin which is spring-loaded, said locking pin being designed and arranged such that it engages said hole when the rod member is in the down position.

12. A security rod assembly according to claim 1 wherein said latching assembly includes a first and a second locking pin, said first locking pin engaging said extension member when said rod member is in the up position and said second locking pin engaging said extension member when said rod member is in the down position.

13. A security rod assembly according to claim 12 wherein said locking pins engage a hole located in the end of said extension member opposite the end of the extension member attached to the connecting plate.

14. A security rod assembly according to claim 13 wherein said latching assembly includes a housing encasing said locking pins and a pin head support which is slidably attached to said housing, wherein said pin head support can be slid under a portion of said second locking pin to hold said second locking pin in a position where it can not engage said extension member.

15. A security door assembly comprising:

a first and a second metal door located in tracks and slidable between an open and a closed position, a security latch assembly including an elongated rod member swingably attached to the tracks of said metal doors, said rod member swingable between an up and a down position, wherein when said rod member is in the down position said rod member extends from an edge of said first door to the edge of the opening containing the doors and prevents said first door from being slid from said closed position to said open position, said security latch assembly also including an end member attached to said rod member, said end member preventing said second metal door from sliding in said tracks when said rod member is in the down position, a latching assembly attached to a wall adjacent to said doors, and, an extension member attached to said rod member and extending beyond said doors to said latching assembly, wherein said extension member engages said latching assembly to hold said rod member in the up and down positions.

16. A security door assembly according to claim 15 further comprising:

a latching member attached to one of said doors that engages said end member when said rod member is in the down position.

17. A security door assembly according to claim 15 wherein said extension member is elongated rod which is attached to said rod member by a connecting plate, said rod member and said extension member being parallel when attached to said connecting plate.

18. A security door assembly according to claim 17 wherein said connecting plate is attached to one of the ends of said rod member and said extension member intermediate of said rod member and said extension member.

19. A security door assembly according to claim 17 wherein said latching assembly includes a first and a second locking pin, said first locking pin engaging said extension member when said rod member is in the up position and said second locking pin engaging said extension member when said rod member is in the down position.

20. A security door assembly according to claim 17 wherein said end member is connected to the end of said rod member opposite the end of said rod member connected to said connecting plate.

21. A security door assembly according to claim 19 wherein said end member is a plate, said plate being parallel to the side edges of said doors.

22. A security door assembly according to claim 21 wherein there is a space between said doors when both of said doors are closed, and wherein said end plate is in this space when rod member is in the down position.

23. A security door assembly according to claim 15 wherein said metal doors are comprised of protective panels, bottom guides and top guides, said protective panels extending between and having attached on their ends said top guide and said bottom guide.

24. A security door assembly according to claim 23 wherein said top guides and said top tracks are designed and arranged such that said metal doors cannot be lifted out of said bottom tracks when the security door assembly is properly installed.

25. A security door assembly according to claim 23 wherein said bottom guide and said top guide engage said tracks and include means for reducing the friction between the guides and the tracks when said doors are slid in said tracks.

26. A security door assembly according to claim 25 further comprising binding plates that overlap the edges of said guides and said panels located on the edges of said doors and are attached to said guides and said end panels.

27. A security rod assembly for use with closures located in top and bottom tracks, at least a first of said closures being slidable between an open and a closed position in said tracks, said security rod assembly comprising:

an elongated rod member swingably attached to the top track such that it has an up position and a down position, wherein when said rod member is in the down position said rod member extends between the edge of said first closure and the edge of the opening preventing said first closure from being slid from the closed position to the open position, and when said rod member is in the open position it does not interfere with the sliding of said first closure, a latching assembly attached to a wall adjacent to said closures, and, an extension member attached to said rod member and extending beyond said closures to said latching assembly, wherein said extension member engages said latching assembly to hold said rod member in the up and down positions.

28. A security rod assembly according to claim 27 wherein said extension member is an elongated rod which is attached to said rod member by a connecting plate, said rod member and said extension member being parallel when attached to said connecting plate.

29. A security rod assembly according to claim 28 wherein said connecting plate is attached to one of the ends of said rod member and said extension member intermediate of said rod member and said extension member.

30. A security rod assembly according to claim 27 wherein said rod member is parallel to the top track and the top edge of said closures.

31. A security rod assembly according to claim 30 wherein said rod member is attached to said top track by a piano hinge.

32. A security rod assembly according to claim 27 wherein said latching assembly includes a first and a second locking pin, said first locking pin engaging said extension member when said rod member is in the up position and said second locking pin engaging said extension member when said rod member is in the down position.

33. A security rod assembly according to claim 32 wherein said locking pins engage a hole located in the end of said extension member opposite the end of the extension member attached to the connecting plate.

34. A security rod assembly according to claim 32 wherein said latching assembly includes a housing encasing said locking pins and a pin head support which is slidably attached to said housing, wherein said pin head support can be slid under a portion of said second locking pin to hold said second locking pin in a position where it cannot engage said extension member.

* * * * *